US005466562A

United States Patent [19]

Marsden

[11] Patent Number: 5,466,562

[45] Date of Patent: Nov. 14, 1995

[54] METHOD OF PHOTOGRAPHIC PROCESSING

[75] Inventor: Peter D. Marsden, Middlesex, England

[73] Assignee: Eastman Kodak Company, Rochester, N.Y.

[21] Appl. No.: 275,888

[22] Filed: Jul. 15, 1994

[30] Foreign Application Priority Data

Jul. 30, 1993 [GB] United Kingdom ..... 9315769

[51] Int. Cl.[6] ..... G03C 7/407; G03D 13/02

[52] U.S. Cl. ..... 430/373; 430/414; 430/399; 430/469; 430/943; 354/336

[58] Field of Search ..... 430/414, 399, 430/373, 469, 943; 354/336

[56] References Cited

U.S. PATENT DOCUMENTS

| | | | |
|---|---|---|---|
| 3,674,490 | 7/1972 | Matejec | 430/376 |
| 3,765,891 | 10/1973 | Travis | 430/351 |
| 4,613,223 | 9/1986 | Cherry et al. | 354/322 |
| 4,954,425 | 9/1990 | Iwano | 430/373 |
| 5,260,184 | 11/1993 | Marsden et al. | 430/414 |

FOREIGN PATENT DOCUMENTS

| | | |
|---|---|---|
| 61-077851 | 4/1986 | Japan . |
| 61-080149 | 4/1986 | Japan . |
| 61-088259 | 5/1986 | Japan . |
| 1403418 | 8/1975 | United Kingdom . |
| 1560570 | 2/1980 | United Kingdom . |

*Primary Examiner*—Charles L. Bowers, Jr.
*Assistant Examiner*—Mark F. Huff
*Attorney, Agent, or Firm*—J. Lanny Tucker

[57] ABSTRACT

A method of processing an imagewise exposed photographic silver halide colour material by a redox amplification method in which the colour material is treated with a colour developing agent in the presence of an oxidant in which a processor is used which comprises means for applying a relatively small volume of processing solution to an imagewise exposed silver halide material and in which the relatively small volume of solution is supplied from a reservoir of relatively large volume and, while processing, the processing solution being used is isolatable from said reservoir and, wherein either a colour developer solution without oxidant or an oxidant solution without colour developing agent is held in the reservoir and wherein the additional oxidant (or colour developing agent) respectively needed for amplification is introduced into the processing solution while it is isolated from said reservoir and wherein the used developer/amplifier so-formed is discarded into said reservoir after use where any unused introduced oxidant (or colour developing agent) is destroyed by a compound present in the reservoir.

10 Claims, 1 Drawing Sheet

METHOD OF PHOTOGRAPHIC PROCESSING

FIELD OF THE INVENTION

The invention relates to photographic processing and, in particular, to a method of processing photographic paper materials.

BACKGROUND OF THE INVENTION

Redox amplification processes have been described, for example in British Specification Nos. 1,268,126, 1,399,481, 1,403,418 and 1,560,572. In such processes colour materials are developed to produce a silver image (which may contain only small amounts of silver) and then treated with a redox amplifying solution (or a combined developer-amplifier) to form a dye image.

The developer-amplifier solution contains a colour developing agent and an oxidising agent which will oxidise the colour developing agent in the presence of the silver image which acts as a catalyst.

Oxidised colour developer reacts with a colour coupler to form the image dye. The amount of dye formed depends on the time of treatment or the availability of colour coupler and is less dependent on the amount of silver in the image as is the case in conventional colour development processes.

Examples of suitable oxidising agents include peroxy compounds including hydrogen peroxide and compounds which provide hydrogen peroxide, e.g. addition compounds of hydrogen peroxide; cobalt (III) complexes including cobalt hexammine complexes; and periodares. Mixtures of such compounds can also be used.

It is well-known to use rotating drums in photographic processing apparatus. Such machines may comprise a horizontally mounted rotatable drum having a textured stainless steel surface whose lower surface dips into the processing solution held in a tray-like container. In a hand-operated drum processor each processing solution is poured into the container and then discarded by tipping the tray when the particular processing step has been carried out for the necessary length of time.

U.S. Pat. No. 4 613 223 discloses a more mechanised embodiment in which a flexible sheet of photographic material is driven along an endless curved path within a processing tank by passing the sheet through nips formed between at least one pair of driven rollers. At least one of the driven rollers is the drum itself. During processing, the emulsion (sensitive) surface of the sheet is arranged not to come into contact with any stationary part of the processing vessel as it is being processed. This prevents damage to the surface during processing. After driving the sheet around the endless path for a predetermined number of cycles, which defines the processing time, the sheet is then directed out of the processing tank.

PROBLEM TO BE SOLVED BY THE INVENTION

A solution containing both an oxidant and a colour developer (i.e. a developer/amplifier solution) is inherently unstable. Many proposals have been made on ways of overcoming this problem but there is still no easy way to achieve the sort of solution stability required for a commercially acceptable process, especially for machine processors which are used intermittently. While it has been shown that using tanks of very small volume can lead to improved results, the problem of solution stability has not been completely solved.

SUMMARY OF THE INVENTION

According to the present invention, there is provided a method of processing an imagewise exposed photographic silver halide colour material by a redox amplification method in which the colour material is treated with a colour developing agent in the presence of an oxidant in which a processor is used which comprises means for applying a relatively small volume of processing solution to an imagewise exposed silver halide material and in which the relatively small volume of solution is supplied from a reservoir of relatively large volume and, while processing, the processing solution being used is isolatable from said reservoir and, wherein either a colour developer solution without oxidant or an oxidant solution without colour developing agent is held in the reservoir and wherein the additional oxidant (or colour developing agent) respectively needed for amplification is introduced into the processing solution while it is isolated from said reservoir and wherein the used developer/amplifier so-formed is discarded into said reservoir after use where any unused introduced oxidant (or colour developing agent) is destroyed by a compound present in the reservoir.

The preferred oxidant is hydrogen peroxide.

ADVANTAGEOUS EFFECT OF THE INVENTION

Only a colour developer solution or oxidant solution (each separately comparatively stable) need be stored in the reservoir while it is not necessary to store a developer/amplifier solution (unstable). The developer/amplifier is effectively formed in situ and then discarded to the developer reservoir where excess oxidant (or developer) is destroyed. No inherently unstable processing solutions need to be stored. The present process is particularly suitable for a processing machine of the small, "table top" type which is used occasionally for discreet sheet materials rather than more or less continuously for material in the form of a web.

DETAILED DESCRIPTION OF THE INVENTION

Figure 1:
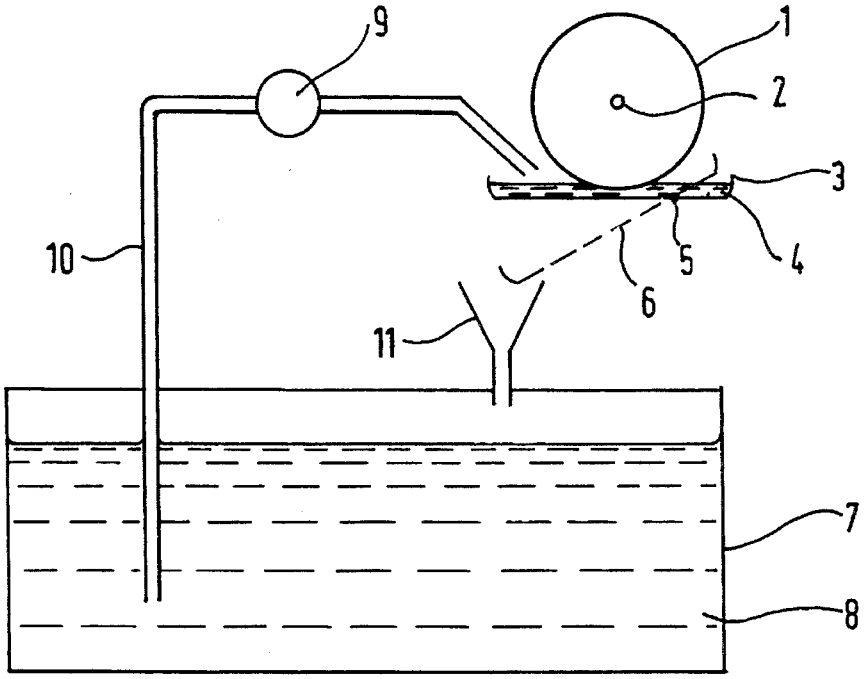
FIGS. 1 and 2 of the accompanying drawings show schematically how processing solutions may be delivered to and drained from a drum processor.

In one embodiment of the present invention the processing solution is applied to the photographic material from a drum processor comprising a horizontally mounted rotatable drum having a textured stainless steel surface.

In one embodiment the relatively small volume of processing liquid is held in a solution container tray from which it can be applied to the photographic material.

Alternatively the processing solution can be applied directly to the rotating drum of a drum processor where it will stay "loaded" onto the drum's surface until the rotation ceases.

Alternatively the processing solution may be applied to the photographic material from a processing machine in which the photographic material is passed through a U-shaped solution container containing the processing solution. Such a tank preferably has a relatively small volume, the sides of the U being spaced 1–4 mm apart.

The introduced oxidant (or developer) solution, may be added either by presoaking the photographic material prior to placing it in the drum processor or it may be added directly to the drum or the processor container when it contains processing solution and after it has been isolated from the reservoir.

The processing solution from the reservoir may be delivered to the drum processor container by means of a pump and returned to the reservoir either by gravity or a pump.

In a preferred embodiment the reservoir contains a colour developer solution and the oxidant is introduced into the processor as a solution or presoaked into the photographic material. In such a case the colour developer solution should contain a scavenger for hydrogen peroxide.

In the alternative case when the reservoir contains oxidant, colour developing agent will be destroyed by the oxidant without any other compound having to be present.

In a preferred embodiment the ratio of the volume of solution in the container to the area of photographic material to be processed is 250–2000 ml/m$^2$, preferably 300–800 ml/m$^2$, and particularly 400–600 ml/m$^2$.

The compound which can destroy hydrogen peroxide (a hydrogen peroxide scavenger) preferably has no deleterious effect on other developer components. An example of such a compound is an alkali metal sulphite e.g. sodium sulphite, or potassium sulphite. It may be present in the developer solution in amounts of 0.2–5.0 g/l, preferably 2.0–3.5 g/l (as sodium sulphite). Alternatively, if it is the colour developing agent that needs scavenging, the hydrogen peroxide already in the reservoir will carry out the function effectively.

The colour developing agent may be present in the colour developer solution in amounts of 1.0 to 7.0 g/l, preferably 3.0–6.0 g/l, particularly 4.0–5.0 g/l.

The container of the drum processor clearly depends on the size of the drum and the material to be processed but typically it may be of rather small volume, preferably from 30 to 250 ml, especially from 50 to 100 ml.

The reservoir of comparatively large volume may be any size which is large enough to rapidly remove oxidant or colour developing agent from the small amount of used developer/amplifier returned to it. Sizes above 0.5 liter, especially of 1 to 2 liters are preferred.

A particular application of this technology is in the processing of silver chloride colour paper, for example paper comprising at least 85 mole percent silver chloride, especially such paper with low silver levels, for example levels below 140 mg/m$^2$, preferably below 100 mg/m$^2$, especially from 25–100 mg/m$^2$.

The amount of used developer/amplifier containing the unused portion of the oxidant or developing agent is returned to the reservoir where it is greatly diluted. This comparatively small amount is soon destroyed leaving the solution stable and ready for use again.

The developing and amplification steps may be followed by optional bleach, fix and stabilise steps which may take place in the same drum processor or elsewhere. Such steps may be carried out with processing solutions employed in the known RA4 process, e.g. the process described for colour paper in the British Journal of Photography (1988) 196–198. When the silver coverage is sufficiently low that the retained silver image does not degrade the colour dye image, then such optional steps may be omitted.

The following two sequences are examples of the way in which the invention may be carried out in a drum processor:

SEQUENCE 1

1. While the drum is rotating a small amount of colour developer solution is pumped into the drum processor container.

2. The container is isolated from the reservoir by turning off the pump or closing a valve.

3. Meanwhile he photographic material is soaked in a dilute hydrogen peroxide solution and is then passed to the drum processor.

4. The material is processed on the rotating drum, removed when processing is over and the drum stopped to allow draining of the processing solution.

5. The container is put into contact with the reservoir and the developer/amplifier is drained into it.

6. The processing is completed on the drum or is removed from the drum and processed elsewhere.

SEQUENCE 2

1. The colour developer is pumped directly from the reservoir onto the rotating drum.

2. Oxidant solution is pumped directly onto the drum where it mixes with the solution already there.

3. The material is processed on the rotating drum.

4. The rotation of the drum is stopped and the developer/amplifier is drained into the reservoir.

5. The processing is completed on the drum or is removed from the drum and processed elsewhere.

Although Sequence 2 can be operated without any solution tray beneath the drum, it would be preferable in such a case to mix the developer and oxidant solutions prior to pumping onto the drum. Alternatively there may be used a solution tray mounted close to the drum and capable of containing a fixed small amount of solution. The fixed small amount would be a volume that would be of a comparable size to the volume required to load the drum and such that good mixing of two solutions separately applied would occur.

The photographic materials to be processed in the present process contain dye-forming couplers. Typically, the couplers are associated with a silver halide emulsion layer coated on a support to form a photographic element. As used herein, the term "associated with" signifies that the coupler is incorporated in the silver halide emulsion layer or in a layer adjacent thereto where, during processing, it is capable of reacting with silver halide development products.

The photographic materials to be processed can be single colour elements or multicolour elements. In a multicolour element, the magenta dye-forming couplers of this invention would usually be associated with a green-sensitive emulsion, although they could be associated with an emulsion sensitised to a different region of the spectrum, or with a panchromatically sensitised, orthochromatically sensitised or unsensitised emulsion. Multicolour elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolour photographic element comprises a support bearing yellow, magenta and cyan dye image-forming units comprising at least one blue-, green- or red-sensitive silver halide emulsion layer having associated therewith at least one yellow, magenta or cyan dye-forming coupler respectively. The element can contain additional layers, such as filter and barrier layers.

The apparatus shown schematically in FIG. 1 of the accompanying drawings comprises a horizontally mounted drum (1) having a textured stainless steel surface rotatable about spindle (2). A tray (3) is mounted beneath the drum adapted to hold processing liquid (4) and tippable about the point (5). The tray in its tipped position is shown by dotted line (6). A processing solution reservoir (7) contains processing liquid (8) which is delivered to the processing tray (3) by pump (9) via pipe (10). When processing is complete tray (3) is tipped thus delivering the used solution back into the reservoir by inlet (11).

Figure 2:
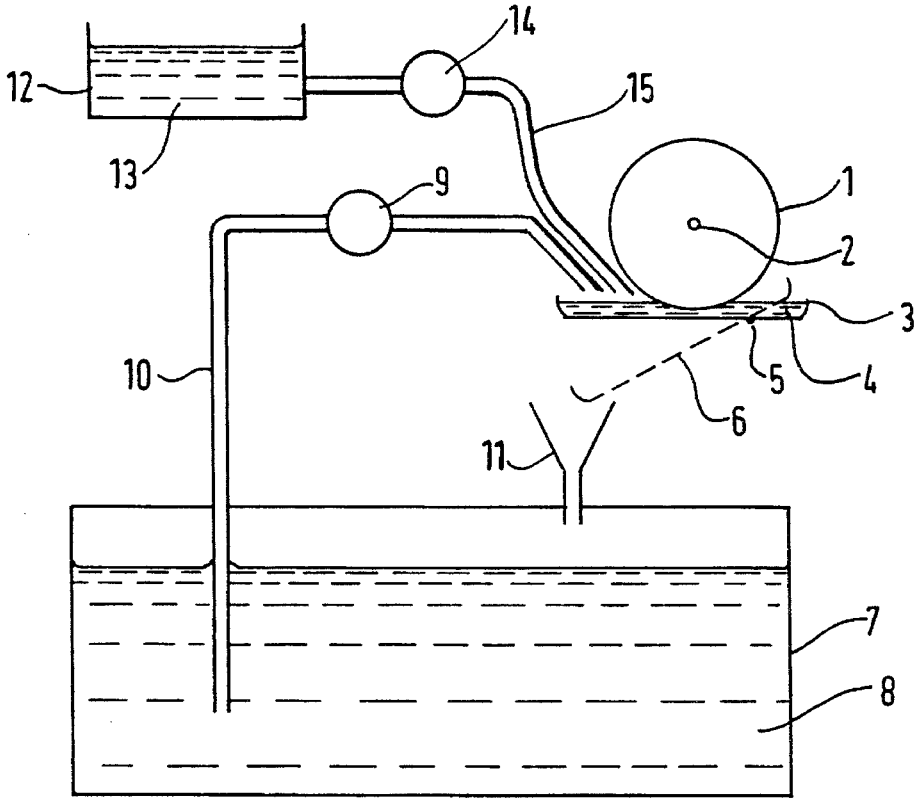

FIG. 2 shows the same apparatus as in FIG. 1 but having a tank (12) from which can be delivered oxidant or developing agent solution (13) by pump (14) via pipe (15) to the tray (3).

In the following discussion of suitable materials for use in the materials processable in this invention, reference will be made to Research Disclosure Item 308119, December, 1989 published by Kenneth Mason Publications, Emsworth, Hants, United Kingdom. This publication will be identified hereafter as "Research Disclosure".

The silver halide emulsion employed can be either negative- working or positive-working. Suitable emulsions and their preparation are described in Research Disclosure Sections I and II and the publications cited therein. Suitable vehicles for the emulsion layers and other layers of elements of this invention are described in Research Disclosure Section IX and the publications cited therein.

The photographic materials can include additional couplers as described in Research Disclosure Section VII, paragraphs F G and H and the publications cited therein. The couplers can be incorporated in the materials and emulsions as described in Research Disclosures of Section VII, paragraph C and the publications cited therein.

The photographic materials or individual layers thereof, can contain brighteners (see Research Disclosure Section V), antifoggants and stabilisers (see Research Disclosure Section VI), antistain agents and image dye stabiliser (see Research Disclosure Section VII, paragraphs I and J), light absorbing and scattering materials (see Research Disclosure Section VIII), hardeners (see Research Disclosure Section X), plasticisers and lubricants (see Research Disclosure Section XII), antistatic agents (see Research Disclosure Section XIII), matting agents (see Research Disclosure Section XVI) and development modifiers (see Research Disclosure Section XXI).

The photographic materials can be coated on a variety of supports as described in Research Disclosure Section XVII and the references described therein. Preferably paper supports, particularly resin coated paper supports, are preferred.

The photographic materials can be exposed to actinic radiation, typically in the visible region of the spectrum, to form a latent image as described in Research Disclosure Section XVIII.

Preferred colour developing agents are p-phenylene diamines. Especially preferred are 4-amino-3-methyl-N,N-diethylaniline hydrochloride, 4-amino-3-methyl-N-ethyl-N-β-(methanesulphonamido)- ethylaniline sulphate hydrate, 4-amino-3-methyl-N- ethyl-N-β-hydroxyethylaniline sulphate, 4-amino-3-β-(methanesulphonamido) ethyl-N,N-diethylaniline hydrochloride and 4-amino-N-ethyl-N-(2-methoxyethyl)-m-toluidine di-p-toluene sulphonate.

Development is optionally followed by the conventional steps of bleaching, fixing or bleach-fixing to remove silver and silver halide, stabilising washing and/or drying.

The following Examples are included for a better understanding of the invention. The word KODAK is a trade mark.

EXAMPLE 1

Development on the drum with a small amount of developer solution in the normal drum tray.

A Kodak H11 drum processor was heated to 32° C. and revolved. 103 ml Of developer (see Table 1) containing a peroxide scavenger (sodium sulphite) was placed in the tray and thus applied to the surface of the drum. A 25×20 cm sheet of photographic colour paper (described below) was exposed to a four colour wedge giving neutral, cyan, magenta and yellow wedges. It was then soaked in the peroxide solution (Table 2) for 15 sec at 32° C., squeegeed and then placed on the rotating drum for 45 seconds.

TABLE 1

| | |
|---|---|
| Water | 800 ml |
| Sodium sulphite | 2.0 g |
| 4-N-ethyl-N-(β-methanesulphon-amidoethyl)-o-toluidine sesquisulphate | 4.86 g |
| 1-hydroxyethylidene-1,1'-diphosphonic acid | 0.77 g |
| Sodium carbonate | 13.3 g |
| Diethylhydroxylamine (85%) | 0.54 g |
| Sodium hydroxide | 1.46 g |
| Potassium chloride | 0.2 g |
| Water to | 1000 ml |
| pH to 10.6 (27° C.) | 10.6 |

TABLE 2

| | |
|---|---|
| Water | 800 ml |
| 100 VOL Hydrogen peroxide | 120 ml |
| Water to | 1000 ml |

TABLE 3

| Process for Examples 1 & 2 | |
|---|---|
| Colour Paper presoak (soln Table 2) | 15 sec (32° C.) |
| Squeegee | |
| Developer (soln Table 1) | 45 sec (32° C.) |
| Stop (2% acetic acid) | 30 sec |
| Wash | 30 sec |
| RA4 Bleach-fix | 30 sec |
| Wash | 2 min |

The (neutral) sensitometric parameters shown in Table A were obtained after the strip had been stopped, bleach-fixed, washed, and dried (see process schedule Table 3).

TABLE A

| Colour Recorded | Dmin | Dmax | Inertial Speed | Shoulder Density | Toe |
|---|---|---|---|---|---|
| Red | 0.122 | 1.85 | 134 | 1.56 | 0.376 |
| Green | 0.135 | 2.33 | 145 | 1.77 | 0.358 |
| Blue | 0.100 | 2.18 | 138 | 1.63 | 0.361 |

After the above process (3 min later) a second strip of colour paper similarly exposed was placed on the drum for 45 sec without the initial peroxide soak. A significant amount of amplification was observed due to the presence of hydrogen peroxide carried over from the first strip (Table B).

TABLE B

| Colour Recorded | Dmin | Dmax | Inertial Speed | Shoulder Density | Toe |
|---|---|---|---|---|---|
| Red | 0.109 | 1.04 | 137 | 1.04 | 0.570 |
| Green | 0.128 | 1.19 | 149 | 1.16 | 0.512 |
| Blue | 0.086 | 1.30 | 138 | 1.21 | 0.475 |

The solution was monitored for activity and this decreased further and became negligible after 10 min as the peroxide was scavenged by the sulphite (Table C).

TABLE C

| Colour Recorded | Dmin | Dmax | Inertial Speed | Shoulder Density | Toe |
|---|---|---|---|---|---|
| Red | 0.106 | 0.58 | 136 | — | — |
| Green | 0.132 | 0.66 | 148 | — | — |
| Blue | 0.084 | 0.75 | 135 | — | — |

This experiment shows that the thin film of developer and indeed the whole of the solution in the drum tray can be made into a developer-amplifier by carrying over peroxide in the colour paper and also that the hydrogen peroxide is eventually scavenged.

To give some indication of the amount of colour development expected without peroxide present, a strip of exposed paper was developed directly on the drum for 45 sec (i.e. without the peroxide soak) and the sensitometric parameters are given in Table D.

TABLE D

| Colour Recorded | Dmin | Dmax | Inertial Speed | Shoulder Density | Toe |
|---|---|---|---|---|---|
| Red | 0.180 | 0.47 | 135 | — | — |
| Green | 0.131 | 0.55 | 149 | — | — |
| Blue | 0.087 | 0.62 | 133 | — | — |

Description of RX Colour Paper used in Examples 1 & 2

The low silver RX colour paper used in Examples 1 and 2 consisted of a seven layer multilayer coating, using experimental pure chloride emulsions and the EKTACOLOR cyan, magenta, and yellow couplers. The total silver laydown of 67 mg/sq m was arranged as follows:

YELLOW: emulsion CEL 0.45 microns, silver L/D 32.2 mg/sq m.

MAGENTA: emulsion CEL 0.25 microns, silver L/D 21.0 mg/sq m.

CYAN: emulsion CEL 0.33 microns, silver L/D 13.6 mg/sq m.

EXAMPLE 2

Attempted amplification on the drum with a large amount of developer in the tray.

For this experiment the normal tray on the H11 drum was replaced by a much larger tray holding 1500 ml of developer containing the scavenger as in Example 1. The tray was levelled so that the solution just touched the bottom surface of the drum in the normal way as it was rotated.

Example 1 was repeated and minimal amplification was observed as shown by the sensitometric parameters given in Table E.

TABLE E

| Colour Recorded | Dmin | Dmax | Inertial Speed | Shoulder Density | Toe |
|---|---|---|---|---|---|
| Red | 0.115 | 0.72 | 136 | — | — |
| Green | 0.128 | 0.80 | 148 | — | — |
| Blue | 0.093 | 0.79 | 135 | — | — |

In this case the peroxide carried over was diluted so rapidly in the large amount of developer that no significant amplification was possible. This experiment shows the principle of stopping amplification by dilution.

The best conditions will arise when the minimum amount of hydrogen peroxide is carried over to the main bulk of developer and this is achieved by keeping the amount of hydrogen peroxide imbibed into the coating to a minimum and by keeping the developer solution on the drum to a minimum. The speed of drum rotation may also be important in this respect.

The invention has been described in detail with particular reference to preferred embodiments thereof, but it will be understood the variations and modifications can be effected within the spirit and scope of the invention.

What is claimed is:

1. A method of processing an imagewise exposed photographic silver halide colour material by a redox amplification method in which the colour material is treated with a colour developing agent in the presence of an oxidant in which a processor is used which comprises means for applying a relatively small volume of processing solution to an imagewise exposed silver halide material and in which the relatively small volume of solution is supplied from a reservoir of relatively large volume and, while processing, the processing solution being used is isolatable from said reservoir and, wherein either a colour developer solution without oxidant or an oxidant solution without colour developing agent is held in the reservoir and wherein the oxidant (or colour developing agent) respectively needed for amplification is introduced into the processing solution while it is isolated from said reservoir and wherein the developer/amplifier solution formed in situ is discarded into said reservoir after use where any unused introduced oxidant (or colour developing agent) is destroyed by a compound present in the reservoir.

2. The method as claimed in claim 1 wherein the processing solution is applied to the photographic material from a drum processor.

3. The method as claimed in claim 1 wherein the relatively small volume of processing solution used for processing is 250–2000 ml/m$^2$ of material to be processed.

4. The method as claimed in claim 3 wherein the relatively small volume of processing solution used for processing is 300–800 ml/m$^2$ of material to be processed.

5. The method as claimed in claim 1 wherein the reservoir contains a scavenger for hydrogen peroxide.

6. The method as claimed in claim 5 in which the scavenger is an alkali metal sulphite.

7. The method as claimed in claim 2 wherein the processing solution for application to the drum is held in a solution container tray.

8. The method as claimed in claim 1 wherein the processing solution is applied to the photographic material from a processing machine in which the photographic material is passed through a U-shaped solution container containing the processing solution.

9. The method as claimed in claim 1 in which the oxidant (or colour developing agent) is introduced directly to the material during processing.

10. The method as claimed in claim 1 in which the photographic material has been soaked in a solution of the oxidant (or developing agent) before being introduced into the colour developer (or oxidant) solution.

* * * * *